United States Patent [19]

Walker

[11] 4,445,026

[45] Apr. 24, 1984

[54] ELECTRICAL DEVICES COMPRISING PTC CONDUCTIVE POLYMER ELEMENTS

[75] Inventor: Jack M. Walker, Portola Valley, Calif.

[73] Assignee: Raychem Corporation, Menlo Park, Calif.

[21] Appl. No.: 167,364

[22] Filed: Jul. 10, 1980

Related U.S. Application Data

[63] Continuation-in-part of Ser. No. 41,071, May 21, 1979, Pat. No. 4,272,471.

[51] Int. Cl.[3] ..... H05B 3/10

[52] U.S. Cl. ..... 219/553; 219/505; 219/541; 219/548; 252/511; 264/104; 338/22 R; 338/331; 338/328; 428/134

[58] Field of Search ..... 219/505, 528, 535, 543, 219/541, 548, 549, 553; 338/22 R, 22 SD, 23, 25, 211, 223, 224, 331, 322, 332, 328; 264/104; 361/58, 106; 428/134; 252/511

[56] References Cited

U.S. PATENT DOCUMENTS

| | | | |
|---|---|---|---|
| 3,351,882 | 11/1967 | Kohler et al. | 338/331 X |
| 3,401,318 | 9/1968 | Jensen | 338/22 R X |
| 3,996,447 | 12/1976 | Bouffard et al. | 219/541 |
| 4,017,715 | 4/1977 | Whitney et al. | 219/553 |
| 4,177,376 | 12/1979 | Horsma et al. | 219/553 |
| 4,177,446 | 12/1979 | Diaz | 219/549 X |
| 4,189,700 | 2/1980 | Hill | 219/553 |
| 4,238,812 | 12/1980 | Middleman et al. | 361/106 |
| 4,272,471 | 6/1981 | Walker | 264/104 |
| 4,317,027 | 2/1982 | Middleman et al. | 219/553 |
| 4,327,351 | 4/1982 | Walker | 338/22 R |
| 4,329,726 | 5/1982 | Middleman et al. | 361/58 |
| 4,352,083 | 9/1982 | Middleman et al. | 338/23 |

FOREIGN PATENT DOCUMENTS

| | | | |
|---|---|---|---|
| 1167551 | 11/1966 | United Kingdom | 219/535 |

*Primary Examiner*—Volodymyr Y. Mayewsky
*Attorney, Agent, or Firm*—Lyon & Lyon

[57] ABSTRACT

Electrical devices comprising a layer of a PTC conductive polymer and a sheet electrode in contact with each face of the PTC layer. The electrodes extend to the sides of the layer and the sides of the layer are concave, and this results in improved performance. Preferred devices are circuit control devices which protect a circuit from increases in current resulting from a fault.

8 Claims, 3 Drawing Figures

ELECTRICAL DEVICES COMPRISING PTC CONDUCTIVE POLYMER ELEMENTS

CROSS-REFERENCE TO RELATED APPLICATION

This application is a continuation-in-part of my copending and commonly assigned application Ser. No. 41,071, filed May 21, 1979 now U.S. Pat. No. 4,272,471, the entire disclosure of which is incorporated herein by reference.

BACKGROUND OF THE INVENTION

1. Field of the Invention

This invention relates to electrical devices comprising a layer of a PTC conductive polymer and a sheet electrode in contact with each face of the layer.

2. Summary of the Prior Art

Such devices are known and include for example heaters and circuit control devices. Reference may be made to U.S. Pat. Nos. 2,978,665 (Vernet et al.), 3,243,753 (Kohler), 3,311,862 (Rees), 3,351,882 (Kohler et al.), 4,017,715 (Whitney et al.) and 4,177,376 (Horsma et al.) and to U.S. Applications Ser. Nos. 965,343 (Van Konynenburg et al), now U.S. Pat. No. 4,237,441, 965,344 (Middleman et al.), now U.S. Pat. No. 4,238,812, and 965,345 (Middleman et al.), now abandoned in favor of continuation-in-part Ser. No. 6,188 the disclosures of which are incorporated herein by reference.

SUMMARY OF THE INVENTION

I have now discovered that the behavior of such a device can be markedly influenced by the shape of the PTC conductive polymer layer adjacent the sheet electrodes, especially when the device is a circuit control device which is subject to high electrical stress. In particular I have found that improved performance is obtained if the electrodes extend to (and optionally beyond) the sides of the conductive polymer layer and the sides of the layer are concave so that the angle between the side of the layer and the electrode is less than 90°, preferably less than 80°. Such a configuration is preferably present around at least 50%, especially substantially 100%, of the periphery of the device. It is believed that, by so shaping the sides of the conductive polymer layer, the likelihood of forming a "hot zone" in close proximity to the edges of the electrodes (with the resultant danger of arcing and other deleterious effects) is substantially reduced. When a PTC element is heated by passage of current through it to a temperature at which it is selfregulating, a very large proportion of the voltage drop over the PTC element takes place over a very small proportion of the element. This small proportion is referred to herein as a "hot zone" and has been referred to in the prior art as a "hot line" or "hot plane".

BRIEF DESCRIPTION OF THE DRAWINGS

The invention is illustrated in the accompanying drawings, in which.

DETAILED DESCRIPTION OF THE INVENTION

Figure 1:
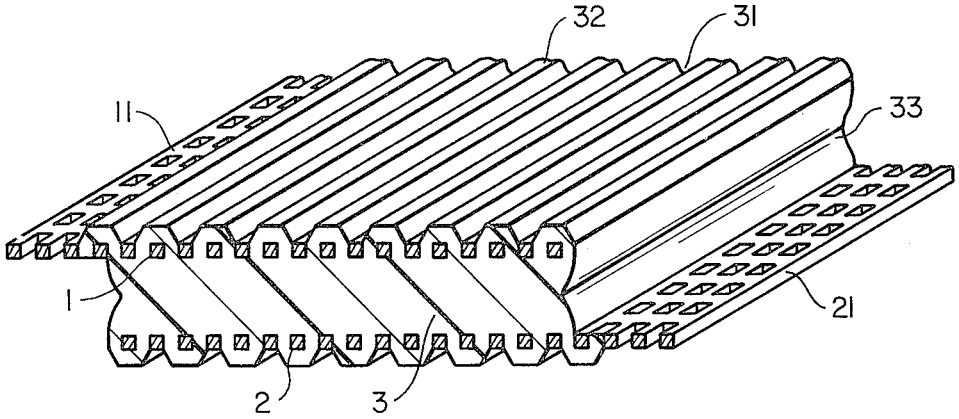
FIG. 1 is a perspective view, partly in cross-section of a device of the invention.

The invention is particularly valuable when the PTC conductive polymer layer is thin, e.g. 0.015 to 1.0 cm, preferably 0.025 to 0.7 cm, especially 0.025 to 0.5 cm, thick and of relatively large area, e.g. 0.2 to 26 $cm^2$, preferably 0.25 to 20 $cm^2$, especially 1 to 10 $cm^2$. Such dimensions are those typically required for a circuit control device, whose resistance should be very small in the normal operating condition of the circuit, preferably less than 50 ohms, e.g. 0.001 to 25 ohms, at 23° C. Preferably the ratio of the equivalent diameter (d) to the thickness (t) is at least 2, preferably at least 10, especially at least 20. The term "equivalent diameter" means the diameter of a circle having the same area as the minimum cross-sectional area of the PTC element.

Suitable PTC conductive polymers are disclosed in the prior art. Preferably they are melt-processable and have a resistivity at 23° C. of less than 100 ohm.cm, especially less than 10 ohm.cm. They may be cross-linked or substantially free from cross-linking.

The sheet electrodes used in the present invention are generally composed of a metal, e.g. nickel or nickel-plated copper, or another material having a resistivity of less than $10^{-4}$ ohm.cm. It is to be understood that when this specification refers to the electrodes as being in contact with the PTC layer, this does not exclude the possibility of a metal electrode which is separated from the PTC layer by a thin layer of another conductive material, e.g. a layer of a relatively constant wattage (ZTC) conductive polymer. Often the electrodes will have openings therein to improve electrical and physical contact between the electrodes and the PTC conductive polymer layer. The electrodes will usually be planar, parallel to each other and of the same dimensions where they contact the PTC layer. In circuit control devices the electrodes may for example have an area of 0.05 to 4.0 $inch^2$ and a length and width of 0.25 to 2.0 inch. Preferably at least one dimension of each electrode is at least 2 times, especially at least 5 times, the thickness of the PTC layer. Where the electrode extends beyond the sides of the PTC element, these dimensions refer to the parts of the electrode which are in contact with the PTC layer.

The devices of the invention can be made by any suitable method. Thus the device can be made with the sides of the PTC element square or convex, and some or (preferably) all of the sides then milled or otherwise shaped to the desired concave shape. A continuous method of making a laminate of two sheet electrodes and a concave-sided layer of a conductive polymer is disclosed in my application Ser. No. 41,071 A continuous laminate made in this way can be cut to length, and preferably the cut sides of the PTC element milled to the desired concave shape.

The concave sides of the PTC element can be of any concave shape. For example they can be smoothly concave or V-shaped. The angle between the side of the PTC element and the electrode is preferably less than 80°, especially less than 70°, particularly less than 60°. Increasing the extent of the concavity is an additional aid in reducing the likelihood of hot zone formation adjacent the electrodes, but also results in a device of higher resistance, which is generally undesirable for circuit control devices. Preferably the extent of the concavity is such that the minimum cross-sectional area of the PTC element is 0.3 to 0.99 times, particularly 0.6 to 0.96 times, its cross-sectional area adjacent the electrodes.

Figure 2:
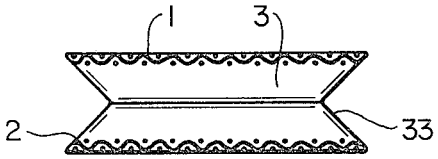
FIGS. 2 and 3 are side and plan views of another device of the invention.
Figure 3:
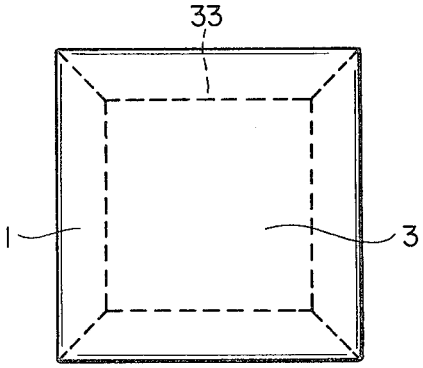

Referring now to the accompanying drawings, these show devices in which metal mesh sheet electrodes 1 and 2 are in contact with opposite faces of a PTC conductive polymer element 3 having concave sides 33. Referring now to FIG. 1, this is a perspective view, partly in cross-section, of an electrical device in which the electrodes 1 and 2 have edge portions 11 and 21 respectively which extend beyond the concave edges 33 of the PTC element 3; in areas 32, the conductive polymer has penetrated into and through the openings in the electrode, and in areas 31, the conductive polymer has penetrated into but not through the openings in the electrode. FIGS. 2 and 3 are side and plan views respectively of another device of the invention, in which metal mesh electrodes 1 and 2 extend to (but not beyond) the edges of the PTC element 3, which has V-shaped edges around the whole of the periphery thereof; in practice, the shape of the grooves will not be as precise as is shown in FIG. 2.

The invention is further illustrated by the accompanying Examples, in which Example 1 is a comparative Example.

EXAMPLE 1 (COMPARATIVE)

The following ingredients were used to prepare a PTC conductive polymer composition.

| | Wt (g) | Wt % | Vol % |
|---|---|---|---|
| Ethylene/acrylic acid copolymer (EAA 455) | 4687 | 29.7 | 38.3 |
| High Density Polyethylene (Marlex 6003) | 3756 | 23.8 | 29.7 |
| Carbon Black (Furnex N765) | 7022 | 44.5 | 29.7 |
| Antioxidant | 316 | 2.0 | 2.3 |

NOTES

EAA 455, which is available from Dow Chemical, is a copolymer of ethylene and acrylic acid (about 8% by weight) having a melt index of about 5.5

Furnex N765 (available from Cities Service Co.) has a particle size (D) of 60 millimicrons, a density of 1.8 g/cc, and a surface area (s) of 32 $m^2/g$ Marlex 6003 is a high density polyethylene with a melt index of 0.3 which is available from Phillips Petroleum Company The antioxidant used was an oligomer of 4,4-thio bis(3-methyl-6-t-butyl phenol) with an average degree of polymerization of 3–4, as described in U.S. Pat. No. 3,986,981

The ingredients were introduced into a steam preheated 11.3 kg. Banbury mixer. After the torque had increased considerably, the steam was turned off and water cooling was begun. Mixing was continued for a further 6 minutes in 3rd gear before the composition was dumped, placed on a steam-heated mill, extruded into a water bath through a 8.9 cm. extruder fitted with a pelletizing die, and chopped into pellets. The pellets were dried under vacuum at 60° C. for 18 hours prior to extrusion.

Using a 1.9 cm. Brabender extruder and a 1×0.25 cm. die, the pellets were extruded into a tape. Nickel mesh electrodes, 1.6 cm. wide, were laminated to each face of the freshly extruded tape, using a stepped roller apparatus as described in the Example of my application Ser. No. 41,071, to produce a laminate having square sides, as shown in FIG. 2 of that application.

The laminate was cut into 1.9 cm. lengths and tin-plated copper leads were spot welded to the portions of the electrodes extending beyond the sides of the PTC layer. Using a $Co^{60}$ gamma radiation source, the samples were irradiated to 20 Mrad, thereby cross-linking the PTC composition. After drying in vaccum at 50° C. for 16 hours, the devices were encapsulated with an epoxy resin and heated at 110° C. for 3 hours to cure the epoxy resin.

EXAMPLE 2

The procedure of Example 1 was followed except that as the laminate of the electrodes and the PTC element emerged from the stepped roller apparatus, a thin disc having a convex edge was rotated in contact with each side of the PTC element, which was still hot, thereby producing a groove about 0.05 cm. deep in each side of the laminate, as shown in FIG. 1 of the accompanying drawings.

A number of devices made by the procedures of Examples 1 and 2 were tested to determine their ability to provide repeated protection against fault currents of 5, 10 and 15 amps. The grooved devices of Example 2 were substantially superior to the devices of Example 1.

I claim:

1. An electrical device which comprises (a) a layer of a conductive polymer composition which exhibits PTC behavior;

(b) a first sheet electrode which contacts one face of said layer; and (c) a second sheet electrode which contacts the other face of said layer;

wherein at least a part of each of said electrodes extends to a side of said layer which is concave adjacent the electrodes so that the angle between each electrode and the side of the layer is less than 80°.

2. A device according to claim 1 wherein each of said electrodes substantially covers a face of said layer.

3. A device according to claim 2 wherein the side of said layer is concave around the whole of the periphery of said layer, so that at all points the angle between each of the electrodes and the side of the layer is less than 80°.

4. A device according to claim 3 wherein each of said electrodes is of metal.

5. A device according to claim 3 wherein each of said electrodes extends beyond the periphery of said layer.

6. A device according to claim 3 which has a resistance at 23° C. of less than 25 ohms.

7. A device according to claim 3 wherein said layer has a substantially constant thickness of 0.025 to 0.7 cm and a cross-sectional area of 0.25 to 20 $cm^2$ and is composed of a conductive polymer having a resistivity at 23° C. of less than 10 ohm.cm.

8. A device according to claim 3 wherein the minimum cross-sectional area of said layer is 0.6 to 0.96 times its cross-sectional area adjacent the electrodes.

* * * * *